US005586723A

United States Patent [19]

Chen et al.

[11] Patent Number: 5,586,723

[45] Date of Patent: Dec. 24, 1996

[54] LIQUID SPRAY NOZZLE WITH LIQUID INJECTOR/EXTRACTOR

[75] Inventors: Shikui Chen, Carol Stream; Ted Butterfield, Naperville, both of Ill.

[73] Assignee: Spraying Systems Co., Wheaton, Ill.

[21] Appl. No.: 319,608

[22] Filed: Oct. 7, 1994

[51] Int. Cl.[6] ..... B05B 3/14

[52] U.S. Cl. ..... 239/102.2; 239/127

[58] Field of Search ..... 239/124, 127, 239/102.1, 102.2, 120, 119

[56] References Cited

U.S. PATENT DOCUMENTS

| | | | |
|---|---|---|---|
| 1,707,696 | 4/1929 | Walker | 239/121 |
| 3,749,315 | 7/1973 | Crathern | 239/121 X |
| 4,204,641 | 5/1980 | Rouse et al. | 239/121 |
| 4,465,234 | 8/1984 | Maehara et al. . | |
| 4,605,167 | 8/1986 | Maehara | 239/102.2 |
| 4,632,311 | 12/1986 | Nakane et al. | 239/102.1 X |
| 5,164,740 | 11/1992 | Ivri . | |

FOREIGN PATENT DOCUMENTS

| | | | |
|---|---|---|---|
| 645720 | 2/1948 | United Kingdom | 239/119 |
| 703425 | 3/1952 | United Kingdom | 239/119 |

*Primary Examiner*—Kevin Weldon
*Attorney, Agent, or Firm*—Leydig, Voit & Mayer, Ltd.

[57] ABSTRACT

Liquid is finely atomized and is ejected through apertures in a disc by virtue of high frequency vibration of the disc at controlled amplitudes. To insure an adequate supply of liquid to the disc while avoiding overflow and droplet leakage through the apertures, an injector meters supply liquid to the disc and simultaneously extracts excess liquid from the disc with a siphon action.

9 Claims, 2 Drawing Sheets

LIQUID SPRAY NOZZLE WITH LIQUID INJECTOR/EXTRACTOR

BACKGROUND OF THE INVENTION

This invention relates generally to an ejector for atomizing and spraying liquids and, more particularly, to a nozzle which includes a vibrating member for generating and atomizing relatively small liquid particles for discharge from the nozzle.

Nozzles of this type are known and are disclosed, for example, in U.S. Pat. Nos. 4,632,311 and 4,465,234. A somewhat similar arrangement is disclosed in U.S. Pat. No. 5,164,740. Such nozzles have particular utility in generating atomized liquid particles which are extremely small in size.

One problem with such nozzles has been in the control of the supply liquid to the vibrating member. If the flow is too small, there is insufficient liquid to supply the nozzle. Excessive supply results in overflow and also in undesirable drippage of liquid from the nozzle in droplet form rather than as an atomized spray.

Prior attempts to control the liquid supply have not been entirely satisfactory. Needle valves have been used but require exact control of the valve setting to insure an adequate flow to the vibrating member without flooding the member and causing drippage.

SUMMARY OF THE INVENTION

The general aim of the present invention is to provide a vibrating member spray nozzle with an improved liquid supply control.

Another object of the invention is to provide a nozzle as characterized above which is adapted to maintain an optimum quantity of liquid at the vibrating member without the use of mechanical valves which require exact setting and control.

Another object is to provide a nozzle of the foregoing type with a liquid control which is relatively simple in construction and economical to manufacture and use.

Another object is to provide in a nozzle of the above character a liquid control which operates without moving parts and thus is substantially trouble free.

These and other objects and advantages of the invention will become more apparent from the following detailed description when taken in conjunction with the accompanying drawings.

Figure 1:
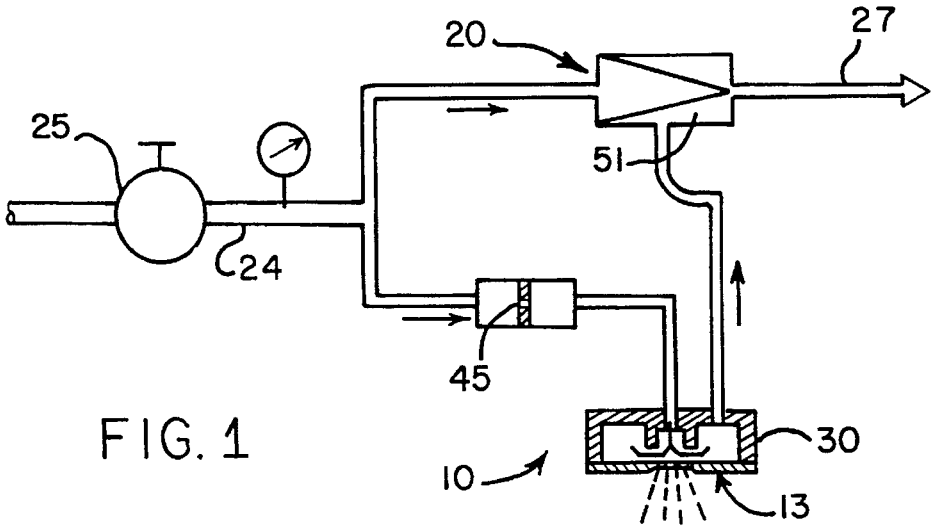
FIG. 1 is a schematic view of a vibrating liquid nozzle equipped with a new and improved liquid control incorporating the unique features of the present invention.
Figure 2:
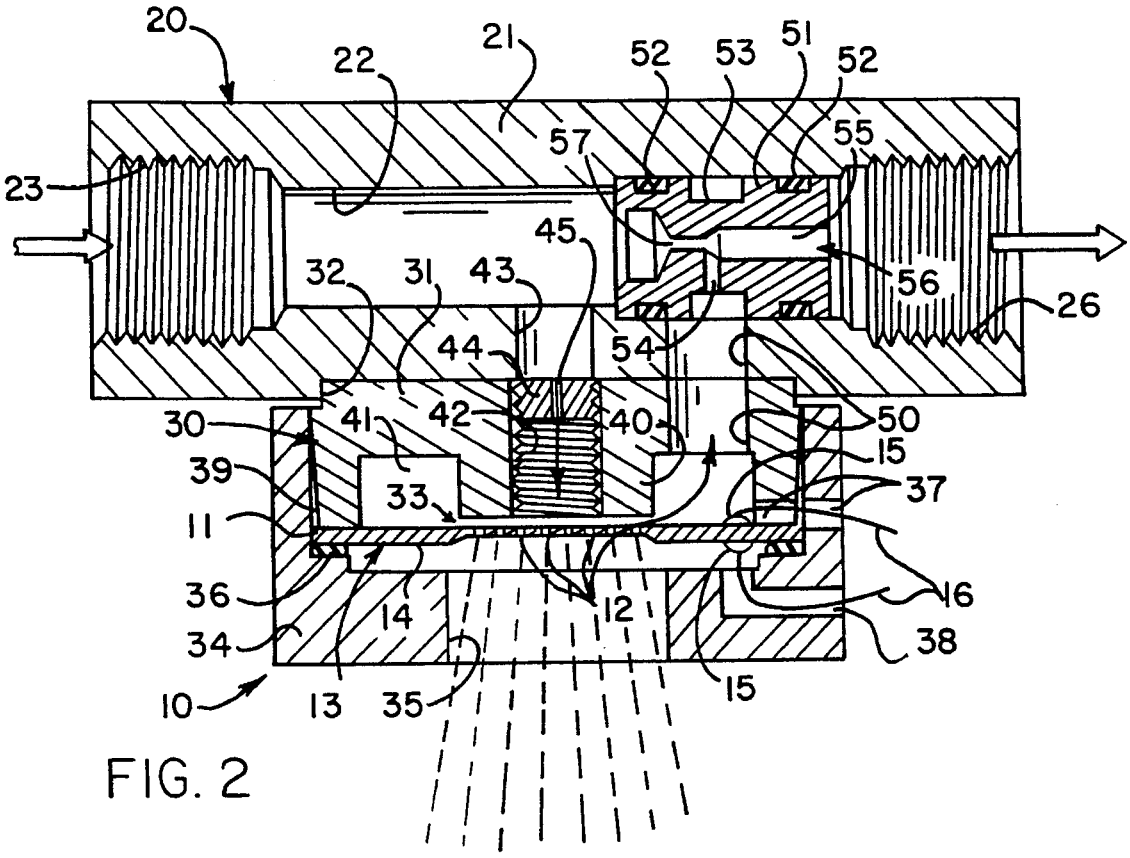
FIG. 2 is a cross-sectional view taken axially through the nozzle and liquid control.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

For purposes of illustration, the invention has been shown in the drawings in conjunction with a liquid ejector or nozzle 10 for receiving a supply of liquid and for discharging the liquid as a finely atomized spray. The present nozzle is of the type which includes a free oscillating surface 11 having microscopic apertures 12 of a selected cross-sectional shape. Liquid is drawn into the apertures and, due to vibration of the surface and the cross-sectional shape of the apertures, is finely atomized and is ejected to a great distance. The ejection action may be developed without any fluid pressure acting on the liquid.

More specifically, the vibrating surface 11 is herein defined by the upper side of a vibrating member 13 in the form of a generally circular disc having a lower side 14, a perimeter area and a recessed center area, the discharge apertures 12 being formed through the center area. The disc 13 preferably is made of piezoelectric ceramic with electrodes 15 secured to each of its sides and connected to a high frequency alternating current voltage source by electrical leads 16. When voltage is applied to the disc 13, its perimeter oscillates vertically while the central area with the discharge apertures 12 oscillates with the same frequency but with a far greater amplitude. When the center area oscillates with an amplitude that exceeds a predetermined level, fluid droplets are ejected from the apertures at the frequency of oscillation. By controlling the amplitude of the oscillation, the ejection of the droplets may be easily regulated.

In order for the nozzle 10 to function effectively, it is necessary to supply liquid to the disc 13 at a rate sufficient to keep a steady flow of spray from the apertures 12. At the same time, it is important that the supply rate not exceed the maximum ejection rate of the apertures because liquid then would tend to overflow from the nozzle and to drip in comparatively large droplets from the apertures rather than being finely atomized.

In accordance with the present invention, liquid is supplied to the apertured disc 13 by a relatively simple and easy-to-use injector 20 which draws off excess liquid from the disc with a siphon action. In this way, the disc is oversupplied with liquid to maintain an optimum spray while overflow and drippage are avoided by drawing excess liquid away from the disc.

More specifically, the ejector comprises a generally circular body 21 having a central passage 22 formed therethrough. One end portion of the passage is threaded as indicated at 23 and is connected to a liquid supply line 24 having an adjustable pressure regulator 25 therein. The downstream end portion 26 of the passage also is threaded and is connected to a return line 27 which recirculates excess liquid to a reservoir (not shown) from which liquid is delivered to the supply line 24.

The body 21 of the ejector 20 preferably serves as a support for the nozzle 10. Herein, the nozzle comprises a generally cylindrical housing 30 having a top wall 31 which is received with a press fit in a pocket 32 formed in the underside of the injector body 21. The housing defines a chamber 33 whose open lower side is closed by the disc 13. The latter is retained by a cap 34 which is press fit onto the housing and which is formed with a large central opening 35 for accommodating the spray from the apertures 12. An O-ring 36 is sandwiched between the cap and the lower side of the peripheral portion of the disc and establishes a seal between the cap and the disc. The extreme outer periphery of the disc becomes clamped between the housing and the O-ring when the cap is pressed onto the housing. To facilitate fitting of the cap onto the housing, the lower end portion of the outer wall of the housing is tapered downwardly as indicated at 36.

Holes 37 are formed through the housing 30 and the cap 34 and an additional hole 38 is formed through the cap to enable the electrical leads 16 to extend outwardly from the electrodes 15 of the disc 13. The holes may be plugged with a suitable sealing material (not shown) after the leads have been threaded through the holes.

A projection 40 is formed integrally with and extends downwardly from the top wall 31 of the housing 30 and its lower end is spaced just above the upper side 11 of the disc 13. As a result of the projection, the chamber 33 is formed with a downwardly opening annular portion 41 which encircles the projection.

Extending vertically through the projection 40 is a threaded bore 42 whose upper end portion communicates with a fluid port 43 formed through the body 21 about midway between the ends thereof and communicating with the passage 22. An insert 44 is threaded into the bore and is formed with a small-diameter inlet orifice 45 which meters liquid from the passage 22 and the port 43 to the chamber 33 and the upper side 11 of the disc 13.

In carrying out the invention, the body 21 and the housing 30 are formed with aligned ports 50 that define an excess liquid outlet which establishes communication between the chamber 33 and the passage 22 at a point downstream of the inlet port 43. An insert 51 is located in the passage 22 near the downstream end thereof and is sealed with respect to the passage by axially spaced O-rings 52. A groove 53 formed circumferentially around the insert between the O-rings establishes communication between the excess liquid ports 50 and a radial passageway 54 in the insert. The passageway 54 also communicates with a relatively large-diameter portion 55 of an axially extending passage 56 formed through the insert 51, the passage 56 being restricted by a small-diameter orifice 57 located upstream of the passageway 54.

With the foregoing arrangement, liquid from the supply line 24 flows into the passage 22 and a portion of such liquid is metered into the chamber 33 and onto the disc 13 via the port 43, the orifice 45 and the bore 42. Upon oscillation of the disc, liquid in the chamber is ejected through the apertures 12 and is atomized.

Liquid flowing in the passage 22 and not injected into the chamber 33 via the inlet port 43 continues toward the insert 51 and, upon flowing through the orifice 57, undergoes a substantial reduction in pressure. As a result, a low pressure area is created in the relatively large-diameter portion 55 of the passage 56. By virtue of the low pressure, excess liquid in the chamber 33 is drawn upwardly therefrom through the ports 50 and the passageway 54 and is discharged from the passages 56 and 22 to the return line 27.

From the foregoing, it will be apparent that the present invention brings to the art a vibrating disc nozzle 10 which is uniquely equipped with a fluid injector 20 that acts with a siphon action to extract excess liquid from the chamber 33 in order to prevent overflow and to prevent droplets from leaking from the apertures 12. The injector is simple in construction and is free of moving parts requiring frequent maintenance or fine adjustment to regulate the flow.

Figure 3:
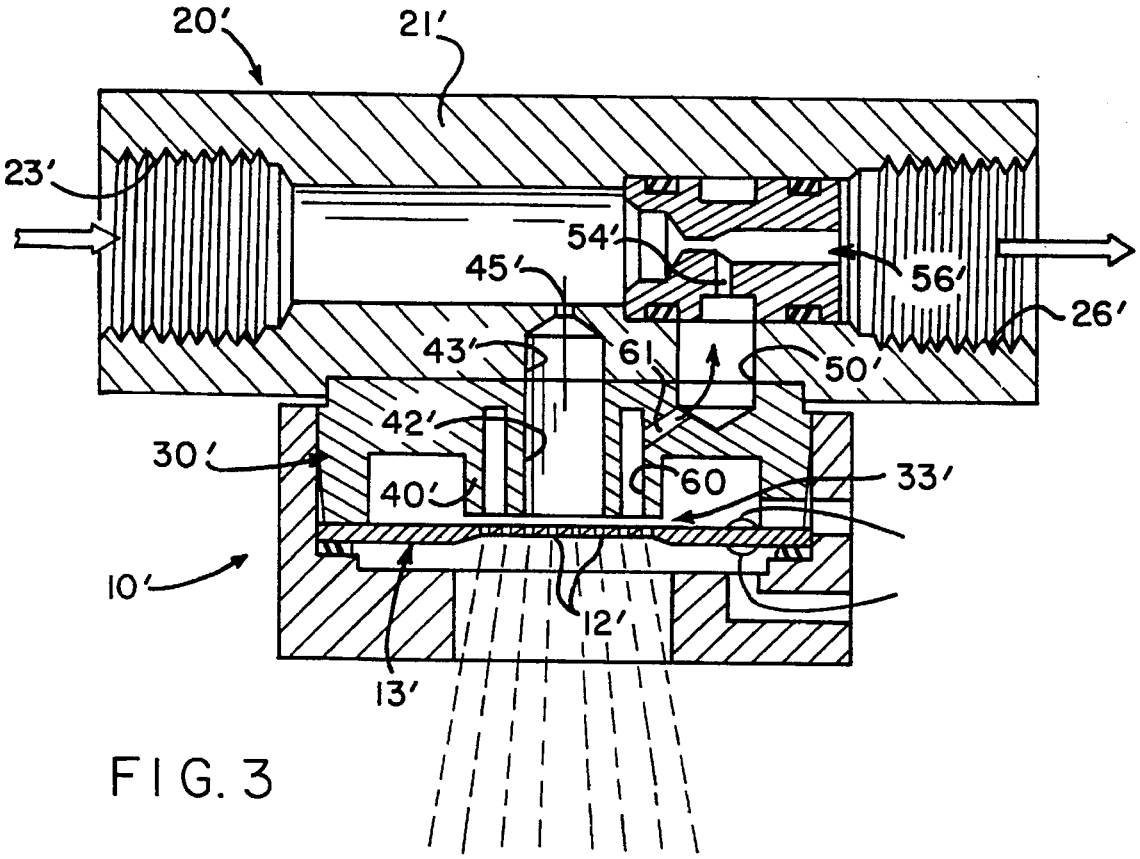
FIG. 3 is a view similar to FIG. 2 but shows a modified embodiment.
Figure 4:
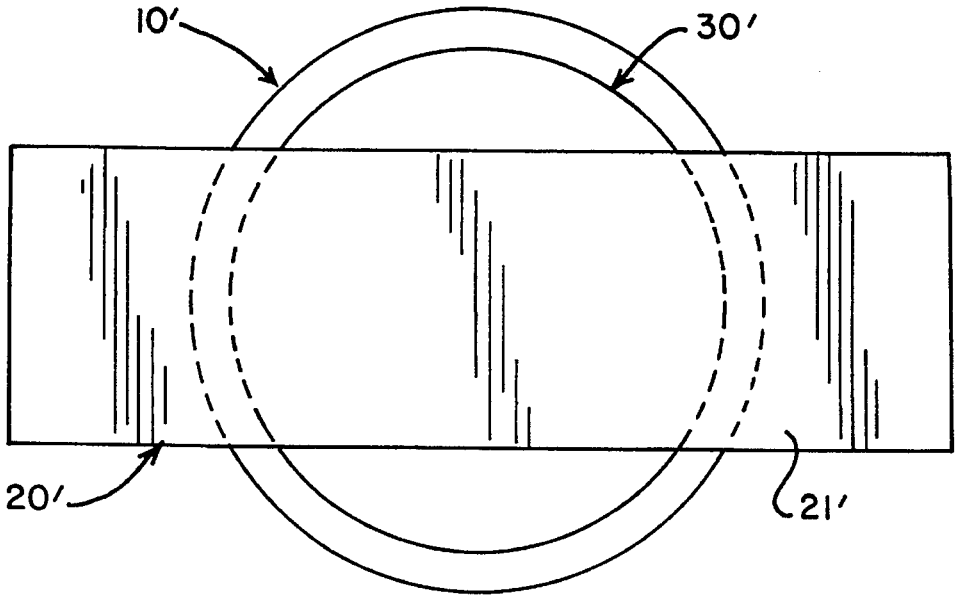
FIG. 4 is a top plan view of the nozzle and liquid control shown in FIG. 3.

Another embodiment of a nozzle 10' is shown in FIGS. 3 and 4 and, in this instance, the body 21' of the injector 20' is of rectangular cross-section. The width of the body is less than the diameter of the housing 30' and, if desired, the upper end of the housing may be open to atmosphere.

In the injector of FIGS. 3 and 4, the orifice 45' is formed in the upper end portion of the inlet port 43' and thus there is no need for an insert in the bore 42'. Also, an annular subchamber 60 is formed in the projection 40' in encircling relation with the bore 42' and communicates at its lower end with the main chamber 33'. A passageway 61 is formed through the projection and extends between the subchamber and the outlet port 50' in the housing to deliver excess liquid to that port.

We claim:

1. A liquid ejector comprising a housing defining a chamber having an open side, a vibratable member having first and second sides and at least one discharge aperture extending between said sides, said first side of said vibratable member closing said chamber, said housing defining a liquid flow passage for supplying liquid to said chamber, said vibratable member being operable upon being vibrated for ejecting at least a portion of the liquid supplied to said chamber through said discharge aperture, and said housing defining a separate excess liquid siphon passage communicating between said chamber and flow passage whereby liquid flowing through said flow passage creates a low pressure in said excess liquid siphon passage for drawing off excess liquid from said chamber.

2. A liquid ejector as defined in claim 1 in which said housing includes a body which defines said chamber and a separate housing member which defines a portion of said flow passage, said body and housing members being assembled with one another with a press fit.

3. A liquid ejector as defined in claim 2 further including an apertured cap captivating said vibrating member in said housing member, said housing member and said cap being assembled with one another with a press fit.

4. A liquid ejector comprising a housing defining a chamber having an open side, a vibratable member having first and second sides and at least one discharge aperture extending between said sides, said first side of said vibratable member closing said chamber, said housing defining a liquid flow passage for supplying liquid to said chamber, said liquid flow passage communicating with said chamber through a restricted inlet whereby only a portion of pressurized the liquid directed through said flow passage passes through said inlet while the remainder of said liquid continues to flow in said flow passage beyond said inlet, and said housing defining an excess liquid siphon passage communicating with said flow passage at a point downstream of said inlet whereby liquid flowing through said flow passage downstream of said inlet creates a low pressure in said excess liquid siphon passage for drawing off excess liquid in said chamber.

5. A liquid ejector as defined in claim 4 in which said housing includes a wall having a projection extending therefrom in closely spaced opposing relation with said first side of said vibratable member, said inlet being formed through said projection, and said chamber including an annular portion encircling said projection.

6. A liquid ejector as defined in claim 5 in which said excess liquid siphon passage is formed through said wall and communicates directly with said annular portion of said chamber.

7. A liquid ejector as defined in claim 5 further including an annular subchamber formed in said projection in encircling relation with said inlet and communicating with said chamber, said excess liquid siphon passage communicating between said subchamber and said flow passage.

8. A liquid ejector as defined in claim 4 in which said liquid flow passage includes a reduced diameter orifice downstream of said inlet which creates a low pressure area, and said excess liquid siphon passage communicates with said low pressure area.

9. A liquid ejector comprising a housing defining a chamber having an open side, a vibratable member having first and second sides and at least one discharge aperture extending between said sides, said first side of said vibratable member closing said chamber, said vibratable member being made of a piezoelectric material which is vibratable when subjected to a high frequency alternating current voltage, said housing defining a liquid flow passage for supplying liquid to said chamber, said vibratable member being operable upon being vibrated for ejecting at least a portion of the liquid supplied to said chamber through said discharge aperture, said housing defining an excess liquid siphon passage communicating with said chamber for drawing excess liquid from said chamber not ejected by said vibratable member as an incident to the supply of liquid through said flow passage.

* * * * *